US005306211A

United States Patent [19]

Pasquier

[11] Patent Number: 5,306,211

[45] Date of Patent: Apr. 26, 1994

[54] ROUNDABOUT WITH TUBULAR GONDOLA

[76] Inventor: Yves Pasquier, Villa Sainte-Thérèse, Jullouville, France, 50610

[21] Appl. No.: 773,618

[22] PCT Filed: Mar. 15, 1991

[86] PCT No.: PCT/FR91/00214

§ 371 Date: Jan. 3, 1992

§ 102(e) Date: Jan. 3, 1992

[87] PCT Pub. No.: WO91/13661

PCT Pub. Date: Sep. 19, 1991

[30] Foreign Application Priority Data

Mar. 16, 1990 [FR] France ..... 90 03431

[51] Int. Cl.[5] ..... A63G 1/24; A63G 27/00

[52] U.S. Cl. ..... 472/44; 472/46; 472/3; 472/30

[58] Field of Search ..... 472/1, 2, 3, 27, 28, 472/29, 30, 31, 44, 39, 42

[56] References Cited

U.S. PATENT DOCUMENTS

| | | | |
|---|---|---|---|
| 1,599,075 | 9/1926 | Burris | 472/30 |
| 2,328,852 | 9/1943 | Shepherd | 472/30 |
| 2,934,341 | 4/1960 | Shepherd | 472/3 |
| 3,196,557 | 7/1965 | Davidsen et al. | 472/30 |
| 3,294,398 | 12/1966 | Buechler | 472/30 |
| 3,666,264 | 5/1972 | Barlett | 472/3 |
| 4,007,926 | 2/1977 | Ottaway | 472/1 |
| 4,410,173 | 10/1983 | Böhme | 472/44 |

*Primary Examiner*—Carl D. Friedman
*Assistant Examiner*—Kien Nguyen
*Attorney, Agent, or Firm*—Staas & Halsey

[57] ABSTRACT

A roundabout having a substantially vertical mast, means forming a support for a gondola mounted to move in a straight line along the mast, driving means for moving the means forming a support along the mast between a low position and a high position and vice-versa, a gondola mounted such that it is mobile with respect to said means forming a support, and wherein there is provided a hub-shaft pair of which one end is integral with the means forming a support and of which the other end is integral with the side surface of a cylindrical drum, the shaft being mounted such that it rotates about a substantially horizontal axis, driving means to rotate the shaft about its substantially horizontal axis, and wherein the gondola includes at least one cylindrical part housed inside the drum, and guiding in rotation to the drum about a substantially vertical axis, and in that the driving means is provided to rotate the cylindrical part of the gondola in the drum, which makes it possible to subject the passengers seated in the gondola to a complete revolution about a substantially vertical axis and to a complete revolution about a substantially horizontal axis.

14 Claims, 4 Drawing Sheets

FIG. 1
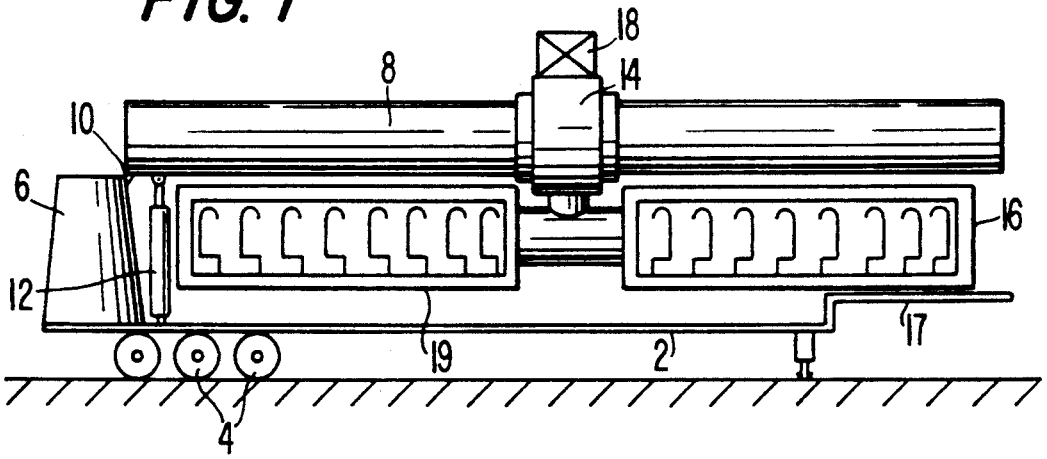
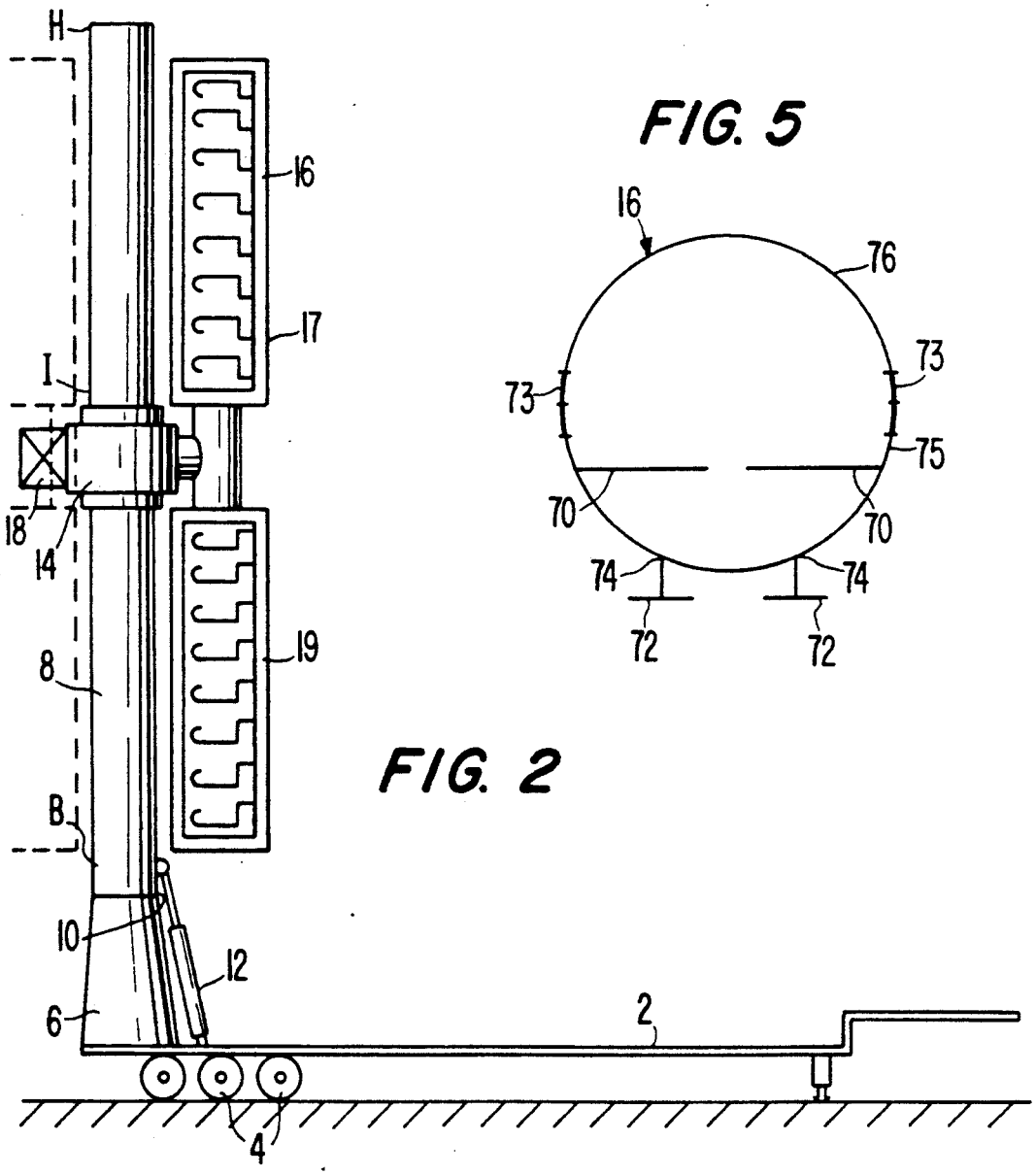
FIG. 2
FIG. 5

ROUNDABOUT WITH TUBULAR GONDOLA

BACKGROUND OF THE INVENTION

1. Field of the Invention

The invention relates to fun fair roundabouts and more particularly to roundabouts with tubular or cylindrical gondolas.

Description of the Related Art

Some fun fair roundabouts are already known which comprise:

a substantially vertical mast;

means forming a support for a gondola mounted to move in a straight line along the mast;

driving means for moving the means forming a support along the mast between a low position and a high position and vice-versa; and at least one gondola integral with the means forming a support and mounted in such a way that it is mobile with respect to said means forming a support.

Most often, the means forming a support for a gondola are also mounted such that they rotate about the mast while driving means are provided to rotate said means forming a support about a substantially horizontal axis.

In general, the gondolas are of ovoid shape. Each gondola is suspended from the end of an arm about which the gondola pivots about a substantially vertical axis.

The passengers firstly take their seats in one of the gondolas when the means forming a support are in the low position.

Then, according to a predetermined sequence, the means forming a support rise up along the mast to a high position and rotate about the mast.

Then the gondola is subjected to a rotary movement about its vertical axis.

Finally the passengers get out of the gondola when the means forming a support have returned to the low position.

The Applicant was faced with the problem of making such roundabouts even more attractive.

SUMMARY OF THE INVENTION

This problem is solved by a roundabout comprising:

a substantially vertical mast;

means forming a support for a gondola mounted to move in a straight line along the mast;

driving means for moving the means forming a support along a mast between a low position and a high position and vice-versa;

at least one gondola mounted such that it is mobile with respect to said means forming a support.

According to the principal characteristic of the present invention, the roundabout furthermore comprises:

a hub-shaft pair of which one of the ends is integral with the means forming a support and of which the other end is integral with the side surface of a cylindrical drum, the shaft being mounted such that it rotates about a substantially horizontal axis;

driving means to rotate the shaft about its substantially horizontal axis; and the gondola comprising at least one cylindrical part housed inside the drum, and guided in rotation in said drum about a substantially vertical axis, and driving means to rotate the cylindrical part of the gondola in the drum, which makes it possible to subject the passengers to a complete revolution about a substantially vertical axis and to a complete revolution about a substantially horizontal axis.

According to a first embodiment of the invention, the roundabout furthermore comprises:

an additional hub-shaft pair of which one of the ends is integral with the means forming a support and diametrically opposite to the hub-shaft pair, the additional shaft being mounted such that it rotates about a substantially horizontal axis;

driving means to rotate the additional shaft about its substantially horizontal axis; and an additional gondola integral with the other end of the additional hub-shaft pair.

According to another aspect of a second embodiment of the invention, the side surface of an additional cylindrical drum is integral with the other end of the additional hub-shaft pair, while the additional gondola comprises at least one cylindrical part housed inside the additional drum, and guided in rotation about said additional drum about a substantially vertical axis, and driving means are provided to rotate the cylindrical part of the additional gondola about the additional drum.

In practice, the gondola is divided into two substantially identical half-gondolas each comprising a male end part respectively fitted into each orifice of the drum and respectively guided in rotation in the drum about a substantially vertical axis and driving means are provided to separately rotate each half-gondola in the drum about a substantially vertical axis.

Similarly, the additional gondola is divided into two substantially identical additional half-gondolas each comprising at least one male end part respectively fitted into each orifice of the additional drum, and respectively guided in rotation in the additional drum about a substantially vertical axis and driving means are provided to separately rotate each additional half-gondola in the additional drum about a substantially vertical axis.

In practice, the means forming a support comprise a slider mounted such that it moves in a straight line along the mast.

According to another characteristic of the invention, the means forming a support comprise a ring guided in rotation about the slider about a substantially vertical axis while driving means are provided to rotate the ring about the slider.

Advantageously, the ring is divided into two half-rings coupled to each other, one of the half-rings being integral with the one of the ends of the hub-shaft pair and the other of the half-rings being integral with one of the ends of the additional hub-shaft pair, the shaft and the additional shaft being mounted such that they rotate about the same horizontal axis.

According to another characteristic of the invention, the mast can be erected while lifting means are provided to erect said mast from a substantially horizontal position to a substantially vertical position and vice-versa.

Advantageously, the roundabout is capable of being folded onto a transport trailer comprising a base provided with an articulation point about which the lifting means articulate.

According to a third embodiment of the invention, the mast is disposed on a platform which moves in rotation and driving means are provided to rotate the platform about its substantially vertical axis.

According to a fourth embodiment of the invention, the roundabout furthermore comprises:

an additional substantially vertical mast;

additional means forming a support, mounted to move in a straight line along the additional mast;

driving means for moving the additional means forming a support along the additional mast between a low position and a high position and vice-versa, in synchronism with the driving means for moving the means forming a support;

an additional hub-shaft pair of which one of the ends is integral with the means forming an additional (sic) support), the additional shaft being guided in rotation about a substantially horizontal axis;

driving means for rotating the additional shaft in synchronism with the means of driving the shaft in rotation, the other end of the additional hub-shaft pair being assembled to the side surface of the drum in a way which is diametrically opposite to the assembly of the other end of the hub-shaft pair and of the drum.

In practice, the mast and the additional mast are disposed on a platform which is mobile in rotation and driving means are provided to rotate the platform about a substantially vertical axis.

Preferably, the driving means are rack driving devices.

BRIEF DESCRIPTION OF THE DRAWINGS

Other characteristics and advantages of the invention will appear in the light of the following detailed description and of the appended drawings in which:

FIG. 1 is a diagrammatic view of the roundabout fitted with a mast in the horizontal position for transporting the roundabout according to the invention;

FIG. 2 is a diagrammatic view of the roundabout fitted with a mast in the vertical position according to the invention;

FIG. 5 is a cross-sectional view of a gondola according to the invention;

Figure 3:
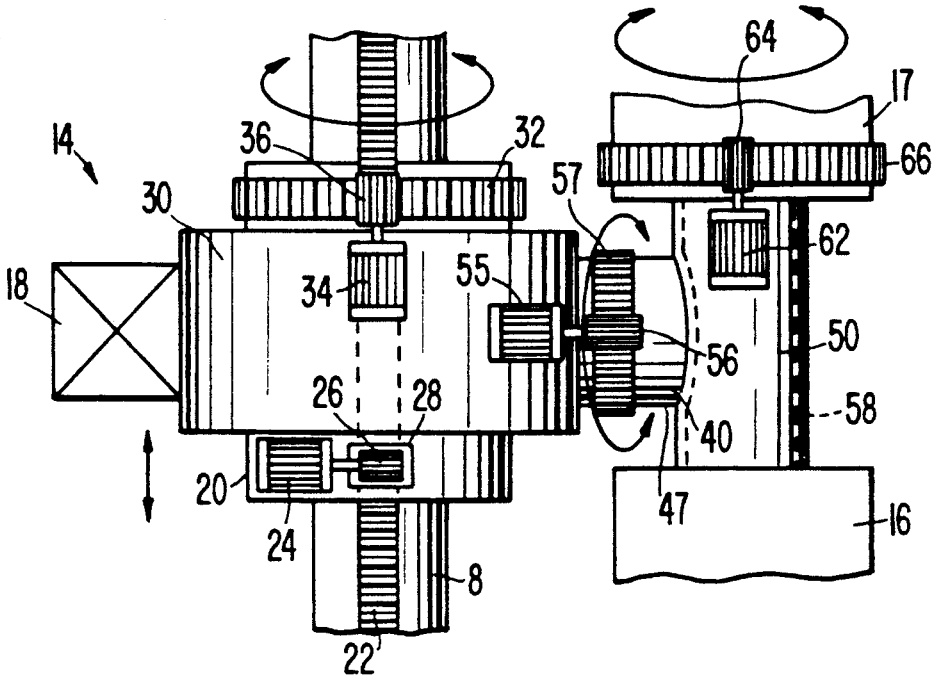
FIG. 3 is a detailed diagrammatic view of the means forming a support for one gondola according to the invention.

The appended drawings comprise numerous elements of definite nature. Consequently they are incorporated in the description not only to allow a better understanding of the latter but also to be used in the definition of the invention if necessary.

DESCRIPTION OF THE PREFERRED EMBODIMENTS

FIG. 1 shows a roundabout in the transport position according to the invention, disposed on a transport trailer 2 provided with wheels 4.

At one of the ends of the trailer 2 there is provided a substantially vertical cylindrical base 6 on which is articulated a cylindrical mast 8 having a cross-section substantially equal to that of the base 6. The mast 8 can be erected from a substantially horizontal position to a substantially vertical position about the point of articulation 10. A lifting device 12 allows the mast 8 to be erected from its horizontal position to its vertical position and vice-versa.

For example, the lifting device 12 may comprise a telescopic jack of the hydraulic or pneumatic type. This jack can be removable. In this case, it is installed for the assembly/disassembly of the roundabout and removed once the roundabout is assembled.

A gondola 16 having a cylindrical configuration is integrally fixed to means forming a support for the gondola 14.

A counterweight 18 is integrally fixed to the means forming a support 14 in a way so as to be diametrically opposite the gondola 16.

FIG. 2 shows the mast according to the invention in the substantially vertical position.

The means forming a support 14 are substantially at mid-height I of the mast 8 between a low position B and a high position H.

Here, the gondola 16 is substantially vertical with respect to the vertical mast.

As will be seen in detail below, the gondola 16 rotates about the means forming a support 14 in a vertical plane like the sails of a windmill.

Reference is now made to FIG. 3. The means forming a support 14 comprise a slider 20 mounted such that it moves in a straight line along the mast B. A rack driving device moves the slider 20 along the mast 8 between a low position B and a high position H and vice-versa.

More precisely, the rack device comprises a rack 22 disposed longitudinally on the mast 8. An electrical motor 24 drives a toothed wheel pinion 26.

The motor 24 is fixed to the outside surface of the slider 20. The pinion 26 works in conjunction with the rack 22 through a window 28 formed in the wall of the slider 20.

The means forming a support 14 also comprise a ring 30 which is guided in rotation about the slider 20 about a substantially vertical axis. The ring 30 partially encloses the slider 20. A rack driving device rotates the ring 30 by means of a toothed wheel pinion 36 working in conjunction with a rack 32 disposed in a ring on one of the free ends of the slider 20. A counterweight 18 is fixed to the ring 30 by the intermediary of conventional fixing means, for example of the nut and bolt type. Diametrically opposite to the counterweight 18, a hub-shaft pair 40 is assembled to the ring 30.

Only the shaft of the hub-shaft pair 40 is shown here.

Figure 6:
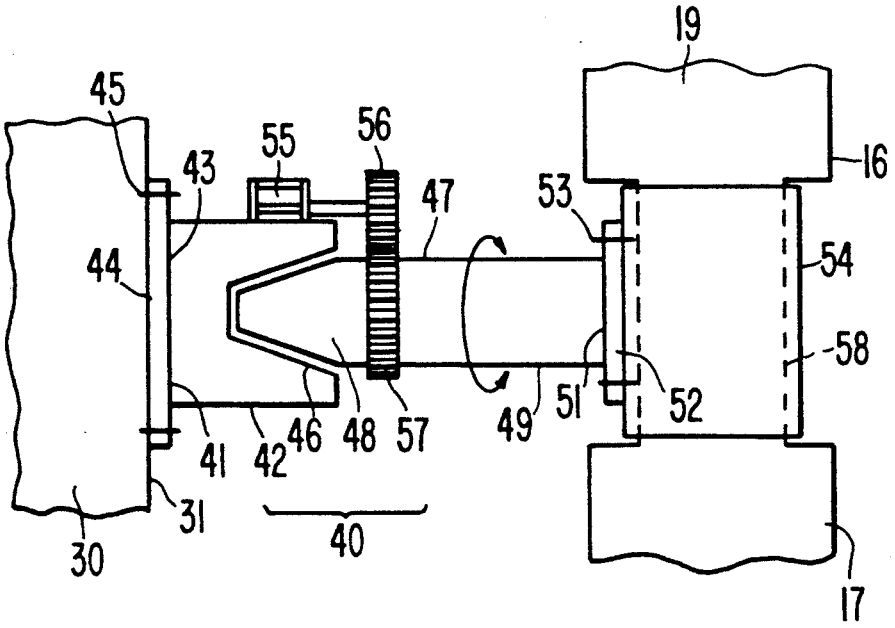
FIG. 6 is a cross-sectional view showing the assembly of the hub-shaft pair on the ring and on the side surface of the drum.

Reference is now made to FIG. 6 which shows the assembly of the hub-shaft pair 40 onto the ring 30.

The end 41 of a cylindrical means 42 is fitted into the orifice 43 of a plate 44 fixed by means of nuts and bolts 45 to the side surface of the ring 31. Inside and outside circlips (not shown) disposed around the hub on either side of the plate 44 allow the assembly of the hub 42 and the ring 30.

The other end 46 of the cylindrical hub 42 is bored in the shape of a female cone.

A shaft 47 comprises a conical fitting 48 at one of its ends. The male cone 48 is lodged in the conical bore 46 leaving a functional play, which allows the male cone 48 to rotate freely in the female cone 46.

The other end 49 of the shaft 47 serves to receive a drum 50 having a cylindrical or tubular configuration. This end 49 of the shaft is fitted into the orifice 51 of a plate 52 fixed by means of nuts and bolts 53 to the side surface of the drum 50. Inside and outside circlips (not shown) disposed around the shaft and on either side of the plate 52 ensure the assembly of the shaft 47 and the drum 50.

The shaft 47 rotates about a substantially horizontal axis with respect to the mast 8 by the intermediary of a rack driving device comprising a motor 55 driving a toothed wheel pinion 56 working in conjunction with a rack 57 disposed in a ring around the shaft 47. The motor 55 is for example placed on the hub 42.

The central and cylindrical section 58 of the gondola 16 is housed in the drum 50 while the two ends 17 and 19 of the gondola are not surrounded by the drum 50. The diameter in the central section 58 is substantially less than the diameter of the drum 50 while the diameter of the end sections 17 and 19 of the gondola is substantially greater than the diameter of the drum 50.

The gondola 16 is mounted such that it rotates in the drum 50 about a substantially vertical axis.

Rack driving means allow the rotation of the gondola 16 in the drum 50. For example, the rack driving system comprises an electric motor 62 driving a toothed wheel pinion 64 working in conjunction with a rack 66 disposed in a ring on the wall of one of the free ends 17 of the gondola.

As a variant, the gondola 16 can be divided into two substantially identical half-gondolas each comprising an end male part respectively fitted into each orifice of the drum and respectively guided in rotation in the drum about a substantially vertical axis. Rack-type driving means then separately rotate each half-gondola in the drum about a substantially vertical axis.

Reference is now made to FIG. 5 which is a diagrammatic representation of a gondola having a substantially tubular configuration according to the invention. It comprises two rows of longitudinally parallel seats 70. For example, footrests 72 which can be retracted with respect to an articulation point 74 are provided for each seat 70. In the raised position, the footrests are housed inside the tubular gondola 16. In the lowered position, the footrests 72 extend outside of the gondola 16 which gives more space to the passengers seated on the seats 70. The upper section of the gondola can be constituted from a transparent material. This upper section 76 can also be assembled to the lower section 75 of the gondola by the intermediary of a spacing part 73 of variable length, which allows the height of the gondola to be varied.

The passengers can be harnessed to the seats 70.

Figure 4:
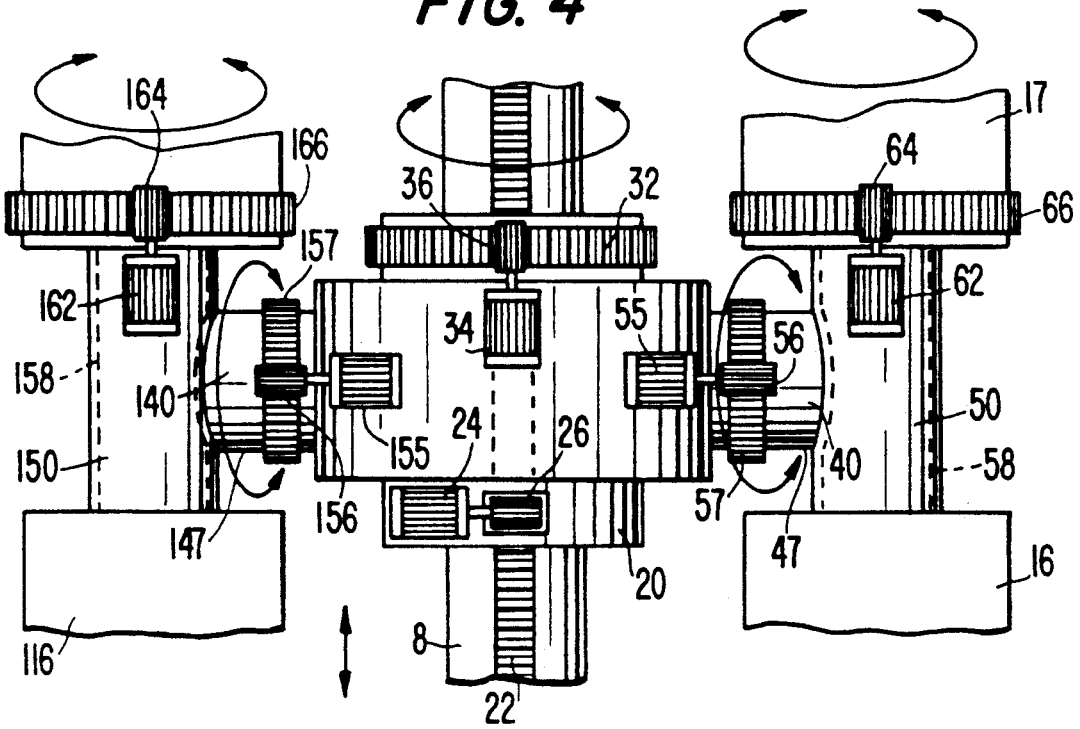
FIG. 4 is a detailed diagrammatic view of the means forming a support for two gondolas according to the invention.

Reference is now made to FIG. 4 which shows means forming a support for two gondolas. Here, the counterweight 18 is replaced by an additional hub-shaft pair 140 of which one of the ends is assembled to the ring 30 in a way which is diametrically opposite to the assembly of the hub-shaft pair 40.

Advantageously, the assembly of the additional hub-shaft pair 140 on the ring 30 is carried out in the same way as the assembly of the hub-shaft pair 40 on the ring 30. The additional hub-shaft pair rotates about a substantially horizontal axis with respect to the mast 8 by the intermediary of a rack driving device comprising a motor 155 driving a toothed wheel pinion 156 working in conjunction with a rack 157 disposed in ring around the additional hub.

An additional shaft 147 serves to receive an additional drum 150 having a substantially cylindrical or tubular configuration. The assembly of the drum 150 on the additional shaft is carried out, for example, in the same way as the assembly of the drum 50 and the shaft 47.

An additional gondola 116, identical to the gondola 16, is housed at least partly inside the additional drum 150. The gondola 116 is mounted such that it rotates like the gondola 16 about a substantially vertical axis. Advantageously, it is driven in rotation by a rack driving system 162, 164 and 166 identical to the driving device of the gondola 16.

FIG. 2 shows the additional gondola 116 in dotted line.

Advantageously, the shaft 47 and the additional shaft 147 are disposed diametrically on the ring 30, substantially along the same horizontal axis.

As a variant, the ring 30 can be divided into two half-rings (not shown) coupled to each other. One of the half-rings is integral with one of the ends of the hub-shaft pair 40 and the other of the half-rings is integral with one of the ends of the additional hub-shaft pair 140. The surfaces of the two half-rings are conjugate such that the shafts 47 and 147 are always aligned along the same substantially horizontal axis.

The roundabout described with reference to FIGS. 1 to 5 functions as follows.

Firstly, the passengers take their seats in the gondola 16 or the gondola 116 where appropriate, when the means forming a support 14 are in the substantially low position B along the mast 8, while the gondola 16 and where appropriate the gondola 116 are maintained horizontal.

Then, the means forming a support 14, by the intermediary of the slider 20, are moved in a straight line along the mast between the low position B and the high position H. If necessary, simultaneously with this rising, the means forming a support, by the intermediary of the ring 30, rotate about the mast 8. If necessary, simultaneously with this rotation the shaft 47 rotates with respect to the ring 30 thus driving the drum in a rotation similar to the rotation of the sails of a windmill. Finally, the gondola rotates in the drum about a vertical axis.

Control means (not shown) control the various electric motors according to a chosen sequence.

In order to return to the initial position, the means forming a support, by the intermediary of the slider 20, are moved in a straight line down to a low position B while maintaining the gondola 16 and where appropriate the gondola 116 in a substantially horizontal position. Finally, the passengers get out of their gondola.

The dimensions of the various components of the roundabout are as follows.

With regard to the trailer 2, its length is in the order of 15 m while its width is about 2.50 m. The height of the base 6 is in the order of 1 m. The height of the chassis of the trailer 2 is in the order of 1 m.

The length of the mast 8 is in the order of 14 m while its diameter is in the order of 1 m. As a variant, the mast 8 may not be a folding mast. It can for example be mounted using a crane. Its length can thus be greater than 14 ms.

The gondola 16 or 116, of substantially tubular configuration, has a diameter of variable value in the order of 1 to 1.50 m. For transportation, the variable spacing part 73 is advantageously in the short position (FIG. 5).

The capacity of each gondola 16 or 116 is in the order of 28 to 32 seats.

The Applicant was faced with the problem of providing a roundabout with two tubular gondolas capable of being transported on a trailer having a width substantially equal to 3 m.

Now, when both of the gondolas and the mast are in the substantially horizontal position, the total width of the components exceeds 2.50 m. In fact, both of the gondolas have a diameter in the order of 1.25 while the mast has a diameter in the order of 1 m, to which must be added the two hub-shaft pairs 140, which results in a total width greater than the width of the trailer.

Figure 7:
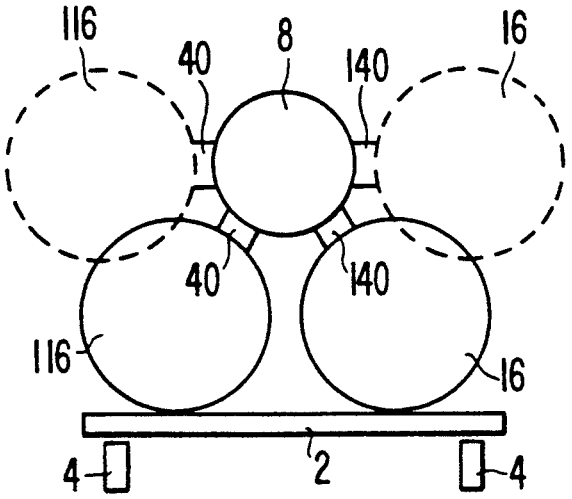
FIG. 7 is a cross-sectional view of the means forming a support for two gondolas in the horizontal position for transporting the roundabout on a trailer.

As shown in FIG. 7, this problem is solved by disconnecting the two gondolas 16 and 116 from the hub-shaft pairs 40 and 140. In this case, the mast 8 remains in the substantially horizontal position while the two gondolas 16 and 116 rest on the trailer 2 under the mast 8.

Another solution consists in disconnecting only one gondola 16 from its hub-shaft pair while the other gondola is slightly inclined in order to rest on the trailer 2.

Finally, in the case in which the ring 30 is constituted by two half-rings each coupled to a gondola, another solution consists in uncoupling the half-rings from each other and rotating them about the mast such that the two gondolas 16 and 116 rest on the trailer 2 underneath the mast 8.

Figure 8:
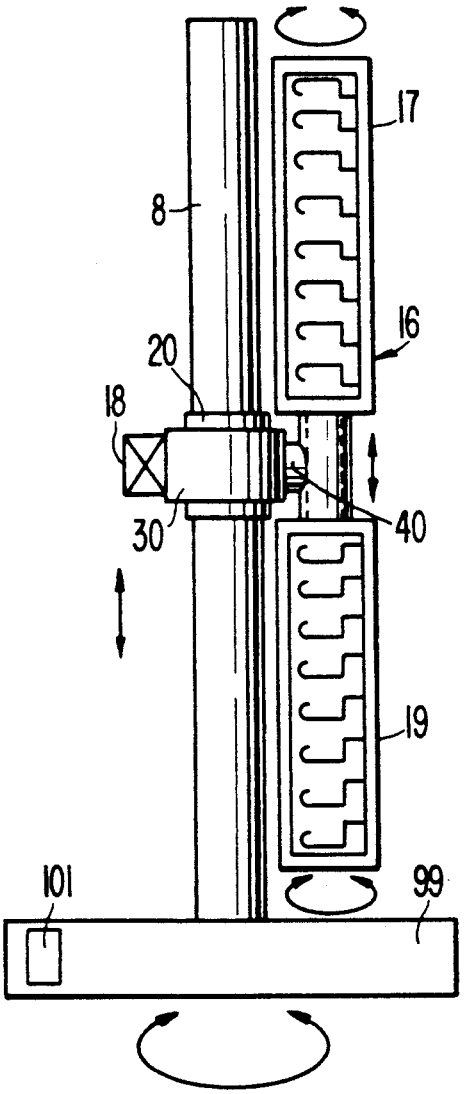
FIG. 8 is a diagrammatic view of a roundabout according to the invention with one mast disposed on a rotating platform.

According to another particular embodiment of the invention, the mast 8 as shown in FIG. 8 is disposed on a circular platform 99 which is mobile in rotation about a substantially vertical axis. Rack driving means 101, for example, are provided to rotate the circular platform about its vertical axis.

Thus, in this embodiment, the passengers seated in the gondola 16 are subjected to the following movements:

1) movement of the slider 20 in a straight line along a vertical axis,
2) rotation of the ring 30 about a vertical axis,
3) rotation of the shaft 47 about a horizontal axis,
4) rotation of the gondola (or of the half-gondola 17 or 19) about a vertical axis, and
5) rotation of the platform 99 about a vertical axis.

Figure 9:
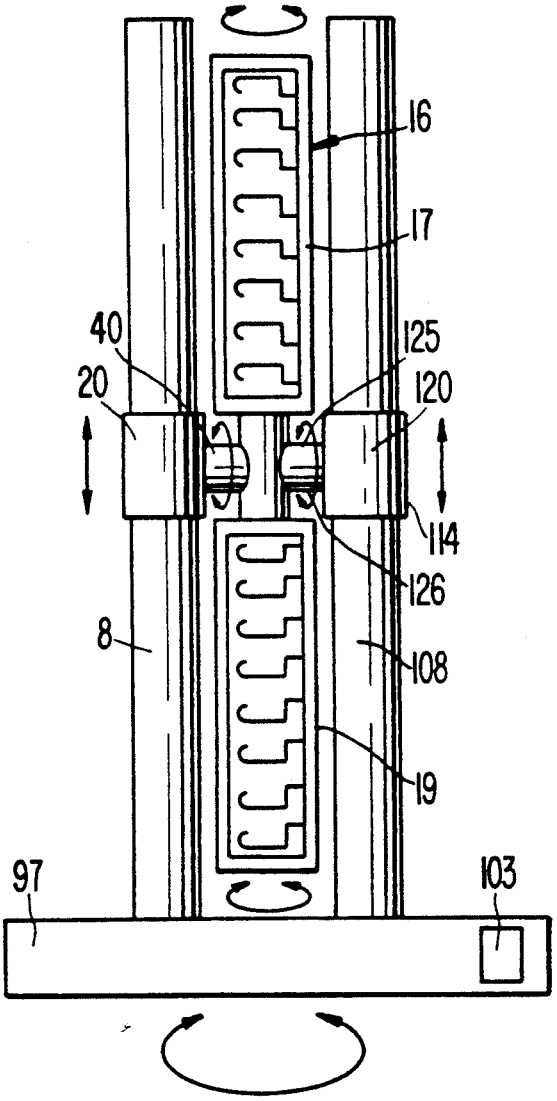
FIG. 9 is a diagrammatic view of a roundabout according to the invention with two masts disposed on a rotating platform.

Reference is now made to FIG. 9. According to yet another embodiment of the roundabout according to the invention, the gondola 16 is interposed between two substantially vertical masts: the mast 8 already described with reference to FIGS. 1 to 3 and an additional mast 108 identical to the mast 8.

Means forming a support 114 such as a slider 120 are mounted to move in a straight line along the additional mast (the ring 30 is eliminated here).

Driving means (not shown) such as a rack system move the slider 120 in a straight line along the mast 108 between a high position and a low position and vice-versa, in synchronism with the rack driving system 22, 24, 26 of the slider 20 described with reference to FIG. 3.

One of the ends of an additional hub-shaft pair 125 is integral with the slider 120. The additional shaft 126 is mounted such that its rotates about a substantially horizontal axis. Here, in order to simplify the representation of the components of the roundabout, only the additional shaft 126 of the additional hub-shaft pair 125 is shown.

Driving means such as a rack driving system rotate the additional shaft 126 in synchronism with the means 55, 56, 57 of driving the shaft 40 in rotation described with reference to FIG. 3.

The other end of the additional hub-shaft pair 125 is assembled to the side surface of the drum 50 in a way which is diametrically opposite to the assembly of the other hub-shaft 40 end and the drum 50.

The gondola 16 thus rotates about a substantially horizontal axis about the two hub-shaft pairs 40 and 125 assembled on either side of the drum 50 inside of which said gondola 16 rotates.

According to another aspect of the invention, the two masts 8 and 108 are disposed on a circular platform which is mobile in rotation 97. Driving means 103, of the rack type for example, rotate the circular platform 97 about a substantially vertical axis.

As before, the gondola 16 can be divided into two half-gondolas capable of rotating separately.

The invention applies generally to fun fair roundabouts intended to offer powerful sensations to a public subjected to a plurality of straight line and rotational movements about different axes but also applies to weight-gaining (sic) simulation devices for training astronauts for example.

I claim:

1. A roundabout comprising:

a substantially vertical mast (8);

means forming a support (14) for a gondola mounted to move in a straight line along the mast (8);

driving means (22, 24, 26) for moving the means forming a support (14) along the mast (8) between a low position and a high position and;

a gondola (16) mounted such that the gondola is mobile with respect to said means forming a support (14); and wherein the gondola further comprises:

a hub-shaft pair (40) of which one end (41) is integral with the means forming a support (14) and of which the other end (49) is integral with the side surface of a cylindrical drum (50), a shaft (47) being mounted so as to rotate about a substantially horizontal axis;

driving means (55, 56, 57) to rotate the shaft (47) about a substantially horizontal axis;

said gondola (16) comprising at least one cylindrical part (58) housed inside the drum (50), and guided in rotation in said drum (50) about a substantially vertical axis, and wherein driving means (62, 64, 66) are provided to rotate the cylindrical part of the gondola (16) in the drum (50), whereby the passengers seated in the gondola are subjected to a complete revolution about a substantially vertical axis and to a complete revolution about a substantially horizontal axis.

2. A roundabout according to claim 1, which further comprises:

an additional hub-shaft pair (140) of which one of the ends is integral with the means forming a support (14) and diametrically opposite to the hub-shaft pair (40), an additional shaft (147) being mounted such that it rotates about a substantially horizontal axis;

driving means (155, 156, 157) to rotate the additional shaft (147) about its substantially horizontal axis; and an additional gondola (116) integral with the other end of the additional hub-shaft pair (140).

3. A roundabout according to claim 2, wherein the side surface of an additional cylindrical drum (150) is integral with the other end of the additional hub-shaft pair, in that the additional gondola 116) comprises at least one cylindrical part (158) housed inside the additional drum (150), and guided in rotation about said additional drum (150) about a substantially vertical axis, and in that driving means are provided to rotate the cylindrical part of the additional gondola (116) about the additional drum (150).

4. A roundabout according to claim 3, wherein the additional gondola (116) is divided into two substantially identical additional half-gondolas each comprising at least one end male part respectively fitted into each orifice of the additional drum, and respectively guided in rotation in the additional drum (150) about a substantially vertical axis and in that driving means are provided to separately rotate each additional half-gondola in the additional drum (150) about a substantially vertical axis.

5. A roundabout according to claim 2, wherein the ring (30) is divided into two half-rings coupled to each other, one of the half-rings being integral with the one of the ends of the hub-shaft pair (40) and the other of the half-rings being integral with one of the ends of the additional hub-shaft pair (140), the shaft (47) and the additional shaft (147) being mounted such that they rotate about the same horizontal axis.

6. A roundabout according to claim 1, wherein the gondola (16) is divided into two substantially identical half-gondolas (17 and 19) each comprising a male end part respectively fitted into each orifice of the drum (50) and respectively guided in rotation in the drum (50) about a substantially vertical axis and in that driving means are provided to separately rotate each half-gondola in the drum (50) about a substantially vertical axis.

7. A roundabout according to claim 1, wherein the means forming a support (14) comprise a slider (20) mounted such that it moves in a straight line along the mast (8).

8. A roundabout according to claim 7, wherein the means forming a support (14) comprise a ring (30) guided in rotation about the slider about a substantially vertical axis while driving means (32, 34, 36) are provided to rotate the ring about the slider (20).

9. A roundabout according to claim 1 wherein the mast (8) can be erected while lifting means (12) are provided to erect said mast (8) from a substantially horizontal position to a substantially vertical position and vice-versa.

10. A roundabout according to claim 9, which is capable of being folded onto a transport trailer (2) and which comprises a base (6) about which the lifting means (12) articulate.

11. A roundabout according to claim 1 wherein the mast (8) is disposed on a platform (99) which is mobile in rotation and wherein driving means (101) are provided to rotate the platform (99) about a substantially vertical axis.

12. A roundabout according to claim 1 which further comprises:

an additional substantially vertical mast (108);

additional means forming a support (114), mounted to move in a straight line along the additional mast;

driving means for moving the additional means forming a support along the additional mast between a low position and a high position and vice-versa, in synchronism with the means of driving (20, 22, 24) the means forming a support (14) in a straight line;

an additional hub-shaft pair (125) of which one of the ends is integral with the additional means forming a support (114), the additional shaft (126) being guided in rotation about a substantially horizontal axis;

driving means for rotating the additional shaft (126) in synchronism with the means of driving the shaft (47) in rotation, the other end of the additional hub-shaft pair (125) being assembled to the side surface of the drum (50) in a way which is diametrically opposite to the assembly of the other end of the hub-shaft pair (40) and of the drum (50).

13. A roundabout according to claim 12, wherein the mast (8) and the additional mast (108) are disposed on a platform (97) which is mobile in rotation and wherein driving means (103) are provided to rotate the platform about a substantially vertical axis.

14. A roundabout according to claim 1 wherein the driving means (20, 22, 24) are rack driving devices.

* * * * *